US008704119B2

(12) United States Patent
Pletenetskyy

(10) Patent No.: US 8,704,119 B2
(45) Date of Patent: Apr. 22, 2014

(54) THIN PROFILE CAM SWITCH ASSEMBLIES

(75) Inventor: Andriy Pletenetskyy, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 90 days.

(21) Appl. No.: 13/444,542

(22) Filed: Apr. 11, 2012

(65) Prior Publication Data

US 2012/0261241 A1 Oct. 18, 2012

Related U.S. Application Data

(60) Provisional application No. 61/474,622, filed on Apr. 12, 2011.

(51) Int. Cl.
*H01H 13/62* (2006.01)

(52) U.S. Cl.
USPC ..... 200/565

(58) Field of Classification Search
USPC ..... 200/548, 565, 11 G, 11 TW, 11 R
IPC ..... H01H 19/11; G05G 1/08,5/03, 1/015
See application file for complete search history.

(56) References Cited

U.S. PATENT DOCUMENTS

| | | | | |
|---|---|---|---|---|
| 6,728,982 | B2 * | 5/2004 | Lemire et al. | 5/603 |
| 6,853,290 | B2 * | 2/2005 | Jorgensen et al. | 338/200 |
| 2005/0145466 | A1 * | 7/2005 | Wang | 200/11 R |

* cited by examiner

*Primary Examiner* — Vanessa Girardi
(74) *Attorney, Agent, or Firm* — Brownstein Hyatt Farber Schreck, LLP

(57) ABSTRACT

Rotational switch assemblies having a thin operational profile are provided for use in electronic devices. Rotational switch assemblies in accordance with embodiments of the invention can include a button, an engagement member, and switch housing. The switch housing includes a radial spring, a post, and at least two contact spring arms. The engagement member includes at least two contact pads and at least two position notches and is mounted to and operable to rotate about the post to one of at least two positions. When the button is moved from one position to another, this movement is translated to the engagement member, which rotates from one position to another, and as the engagement member rotates, the radial spring engages the position notch corresponding to the position of the engagement member, and one of the contact pads engages a corresponding one of the contact spring members for that position.

20 Claims, 7 Drawing Sheets

THIN PROFILE CAM SWITCH ASSEMBLIES

This application claims the benefit of U.S. Provisional Patent Application No. 61/474,622, filed Apr. 12, 2011, the disclosure of which is incorporated by reference in its entirety.

BACKGROUND OF THE DISCLOSURE

Electronic devices may include several types of input components that can be used by a user for providing instructions or commands to the electronic device. For example, the input component may be a switch assembly including a button that may be moved to one of at least two different positions. The button may be aligned with a slider that can slide along a linear track. Consequently, as the button is moved from one position to another, the movement of the button causes the slider to slide along the track. A switch box can be coupled to the slider via an engagement member that can detect mechanical movement of the slider and translate this movement into electrical signals. These electrical signals can then be interpreted by other components of an electronic device in order to alter a functional state of the device.

Given the trend to incorporate more features into devices, while simultaneously maintaining or shrinking the physical dimensions of the device, other components such as switch assemblies within the device may need to shrink. Accordingly, switch assemblies constructed with a thin operational profile are needed.

SUMMARY OF THE DISCLOSURE

Rotational switch assemblies having a thin operational profile are provided for use in electronic devices. Rotational switch assemblies in accordance with embodiments of the invention can include a button, an engagement member, and switch housing. The switch housing includes a radial spring, a post, and at least two contact spring arms. The engagement member includes at least two contact pads and at least two position notches and is mounted to and operable to rotate about the post to one of at least two positions. When the button is moved from one position to another, this movement is translated to the engagement member, which rotates from one position to another, and as the engagement member rotates, the radial spring engages the position notch corresponding to the position of the engagement member, and one of the contact pads engages a corresponding one of the contact spring members for that position.

BRIEF DESCRIPTION OF THE DRAWINGS

The above and other aspects of the invention, its nature, and various features will become more apparent upon consideration of the following detailed description, taken in conjunction with the accompanying drawings, in which like reference characters refer to like parts throughout, and in which.

DETAILED DESCRIPTION OF THE DISCLOSURE

Figure 1:
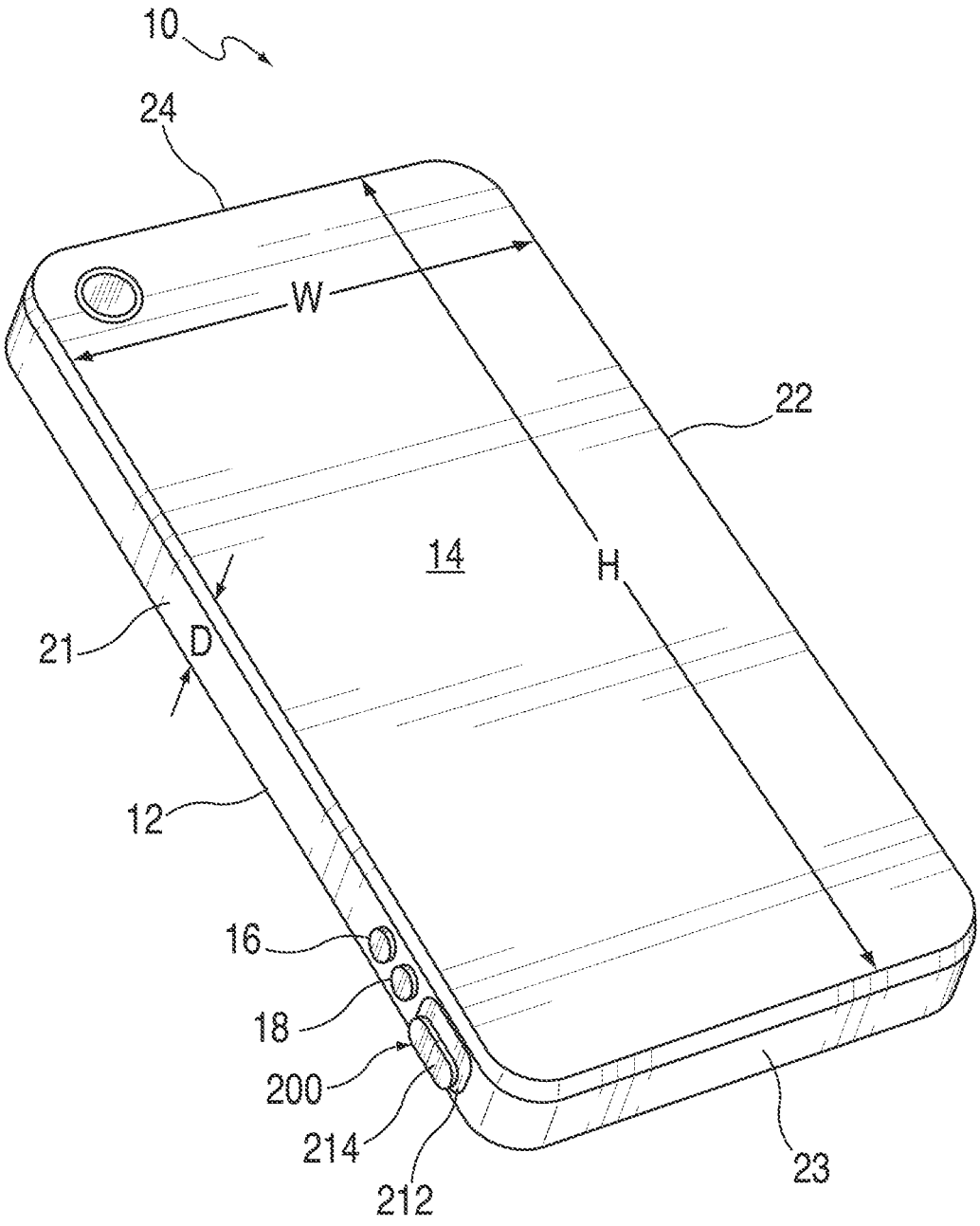
FIG. 1 is an illustrative bottom perspective view of an electronic device having a switch assembly in accordance with some embodiments of the invention.

FIG. 1 shows an illustrative perspective view of an electronic device 10 in accordance with an embodiment of the invention. Electronic device 10 may generally be any portable, mobile, hand-held, or miniature electronic device having a switch assembly. Miniature electronic devices may have a form factor that is smaller than that of hand-held personal media devices, such as an iPod™ Shuffle available by Apple Inc. of Cupertino, Calif. Illustrative miniature electronic devices can be integrated into various objects that include, but are not limited to, watches, rings, necklaces, belts, accessories for belts, headsets, accessories for shoes, virtual reality devices, other wearable electronics, accessories for sporting equipment, accessories for fitness equipment, key chains, or combinations thereof. Alternatively, electronic device 10 may not be portable at all.

Electronic device 10 may include at least one input component (see, e.g., buttons 16 and 18 and switch assembly 200 of FIG. 1) that can allow a user to manipulate at least one function of the device, at least one output component that can provide the user with valuable device generated information, and a housing (see, e.g., outer periphery member 12 and cover 14 of FIG. 1) that can at least partially enclose the one or more input components and the one or more output components of the device.

As shown in FIG. 1, for example, device 10 can be hexahedral and may include a top wall 23, a bottom wall 24 opposite top wall 23, a right side wall 22, a left side wall 21 opposite right side wall 22, a front wall (not shown), and a back wall 14 opposite front wall. Each of the walls of device 10 may be substantially flat (see, e.g., right side wall 21), though the contours of one or more of the walls of device 10 can be at least partially curved, jagged, or have any other suitable shape or combination thereof.

Generally, device 10 may be said to have a depth D that may be defined by the gap between back wall 14 and the front wall (not shown). Similarly, housing 400 may be said to have a width W that may be defined by the length between right side wall 22 and left side wall 21. Finally, device 10 may be said to have a height H that may be defined by the length between top wall 23 and bottom wall 24. It should be noted that the design of device 10 described above is only exemplary and need not be substantially hexahedral, and that, in certain embodiments, the intersects of certain walls may be beveled, and device 10 itself could generally be formed in any other suitable shape, including, but not limited to, substantially spherical, ellipsoidal, conoidal, octahedral, or a combination thereof, for example.

Figure 2:
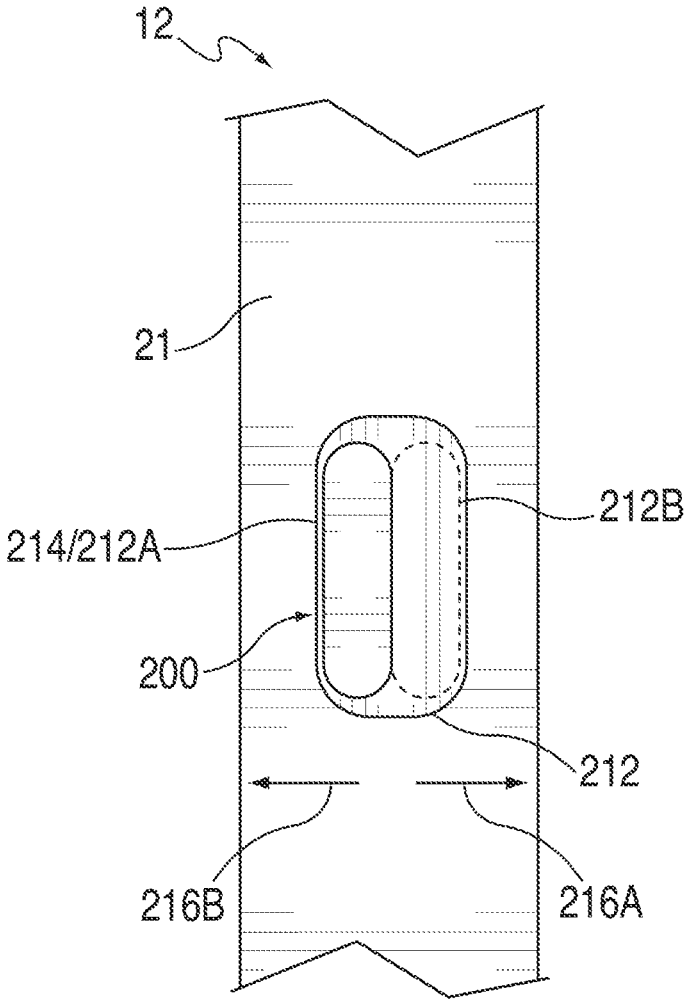
FIG. 2 is an illustrative left side view of a portion of the electronic device and switch assembly of FIG. 1 in accordance with some embodiments of the invention.

Electronic device 10 can include at least one switch assembly 200. As shown in FIGS. 1 and 2, for example, switch assembly 200 can include track 212 that is disposed along and through a portion of left side wall 21. It is to be understood that track 212 of switch assembly 200 may be provided along and through any portion of any wall or walls of device 10 and not just left side wall 21.

Switch assembly 200 may also include a button 214 that can slide within and along track 212 between at least two button positions to change a functional state of device 100 (e.g., to power the device up or to power the device down or to switch the ringer between a vibrate mode or a ring mode). For example, as shown in FIG. 2, button 214 may slide within track 212 between a first button position adjacent a first end 212A of track 212 and a second button position adjacent a second end 212B of track 212. In such embodiments, a user of device 100 can slide button 214 along track 212, either in the linear direction of arrow 216A away from the first button position adjacent first track end 212A and towards the second button position adjacent second track end 212B or in the linear direction of arrow 216B away from the second button position adjacent second track end 212B and towards the first button position adjacent first track end 212A. Additionally or alternatively, in some embodiments, button 214 may slide within track 212 from the first button position adjacent first track end 212A and/or from the second button position adjacent second track end 212B to a third button position (not shown) in between first track end 212A and second track end 212B to change a functional state of device 10.

Referring now to FIGS. 3-6, for example, switch assembly 200 may also include a switch housing 230 coupled to button 214 by button/switch engagement member 240. Switch housing 230 may be any suitable switching component, such as an electromechanical switching component, that can translate the mechanical movement of button 214 along track 212 into associated electrical signals to be interpreted by other components of electronic device 10 for potentially altering a functional state of device 10. For example, switch housing 230 may include post 232, contact spring arms 234, and radial spring 236.

Figure 3A:
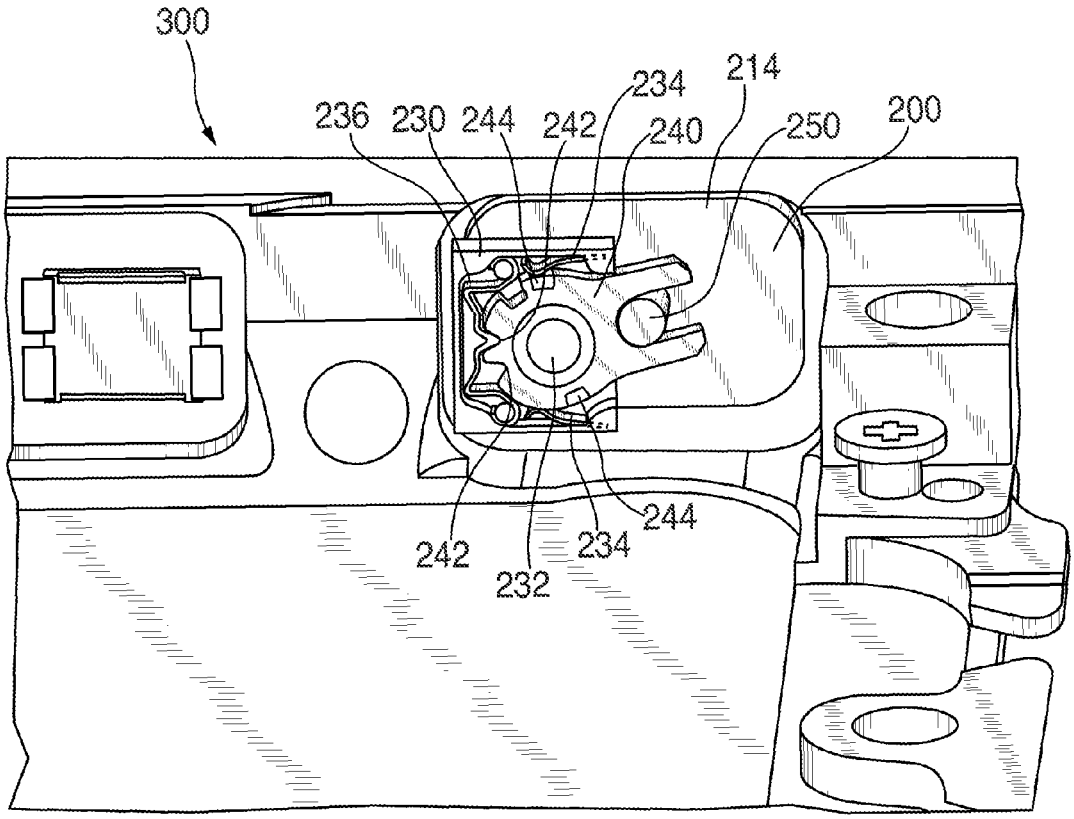
FIGS. 3A and 3B are simplified illustrative cross-sectional views of the portion of the electronic device and switch assembly of FIGS. 1 and 2 in accordance with some embodiments of the invention.

Engagement member 240 may be coupled to button 214 (e.g., via pin 250) and to post 232, and engagement member 240 may rotate about an axis (e.g., center axis) of post 232 between different switch positions when button 214 correspondingly moves between different button positions along track 212. Engagement member 240 can include position notches 242 and switch contact pads 234. When button 214 moves between different positions, radial spring 236 engages one of position notches 242 and one of contact pads 244 is electrically connected to one of contact spring arms 234. FIG. 3A shows switch assembly 200 in a first switch position (in which engagement member 240 is pointed up and spring 236 engages the "top" position notch 242), and FIG. 3*b* shows switch assembly 200 in a second switch position (in which engagement member 240 is pointed down and spring 236 engages the "bottom" position notch 242).

Contact spring arms 234 may be electrically coupled to an electronic component (e.g., a processor (not shown)) of device 10, for example, via a circuit board (not shown) of device 10. When button 214 is at a functional button position along track 212, engagement member 240 is positioned so that one of its contact pads 244 is in contact with a respective contact spring arm 234 associated with that functional button position, and switch housing 230 may thereby change the function or logic of an electronic component of device 10 in response to engagement member 240 being in that position.

In some embodiments, switch 230 of switch assembly 200 may be any type of switching component, including, but not limited to, a single pole single throw ("SPST") switch, a single pole double throw ("SPDT") switch, a single pole center off ("SPCO") switch, a double pole single throw ("DPST") switch, a double pole double throw ("DPDT") switch, a double pole center off ("DPCO") switch, a maintained contact switch, a momentary contact switch, a fader or limitless contact switch, or combinations thereof.

Figure 3B:
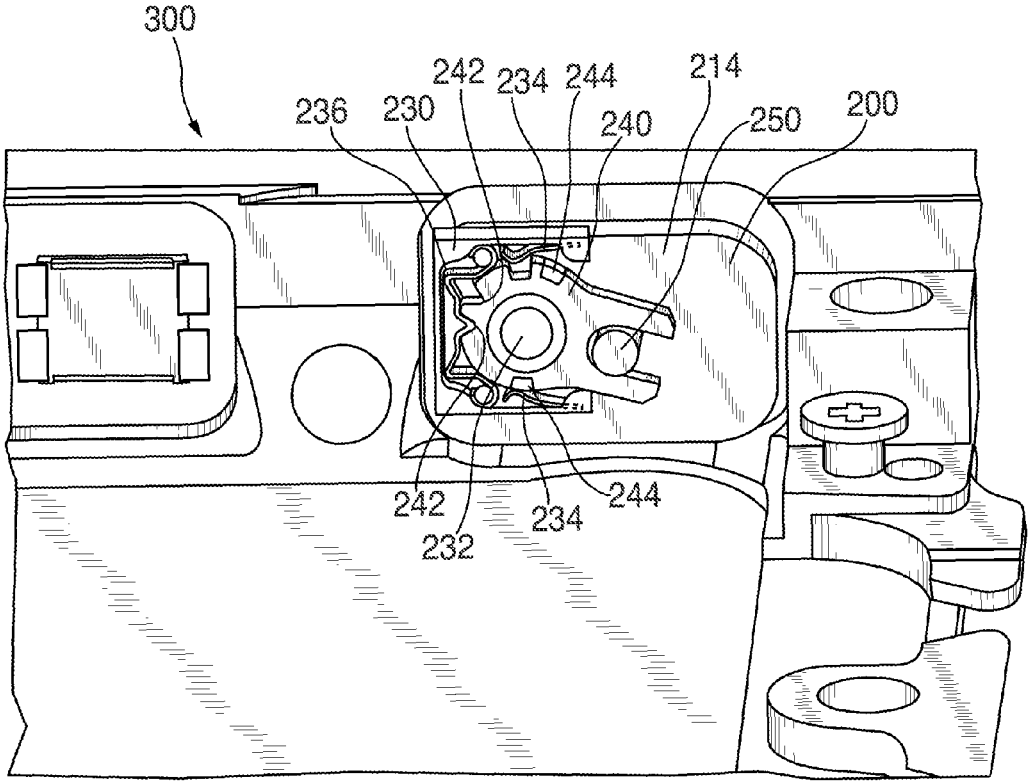
Figure 4:
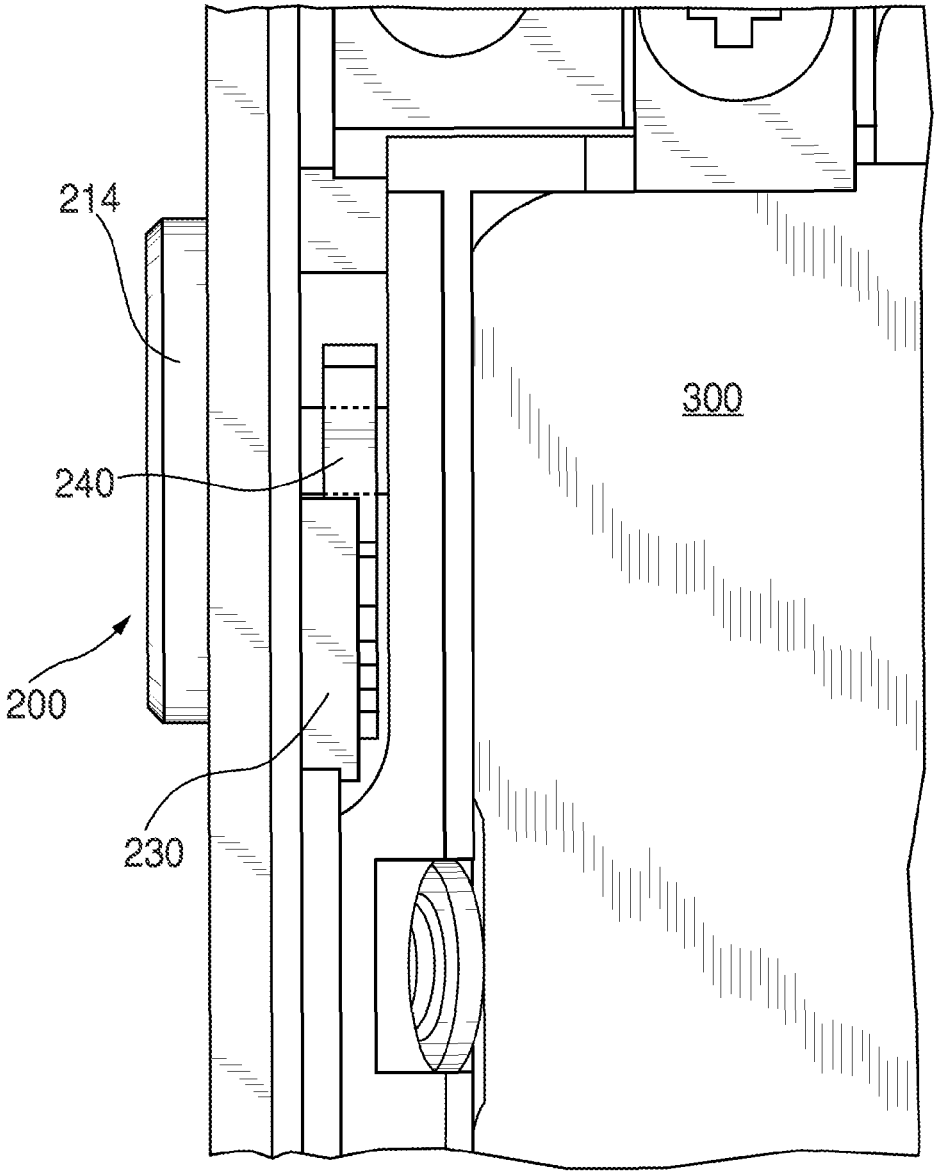
FIG. 4 is a simplified illustrative cross-sectional view of the portion of the electronic device and switch assembly of FIGS. 1 and 2 in accordance with some embodiments of the invention.

Referring to FIGS. 3A, 3B and 4, illustrative views of switch assembly 200 incorporated in an electronic device 300 are shown. As shown, switch housing 230 and engagement member 240 are mounted adjacent to a sidewall of device 300. In particular, housing 230 is mounted such that engagement member 240 rotates in a plane that is co-planer to a plane of the sidewall.

Figure 5:
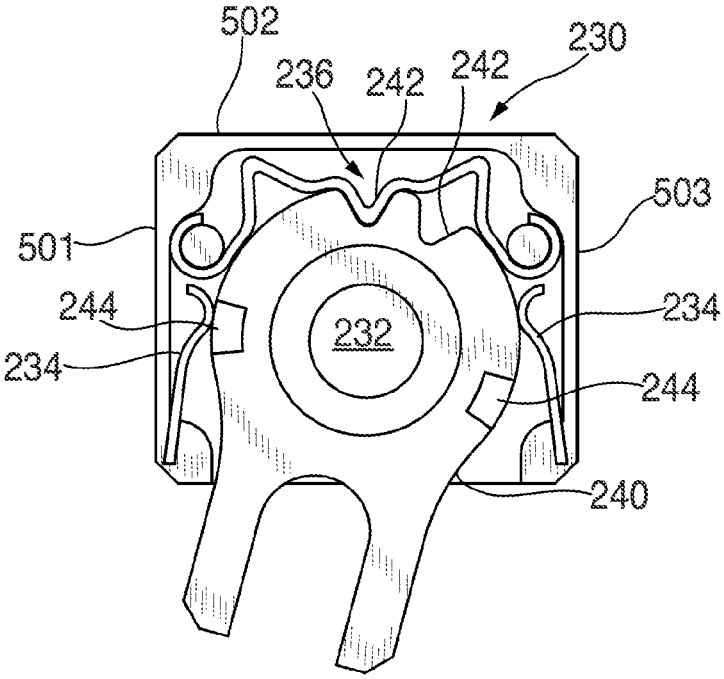
FIG. 5 is a simplified top view of a switch housing and engagement member in accordance with some embodiments of the invention.
Figure 6:
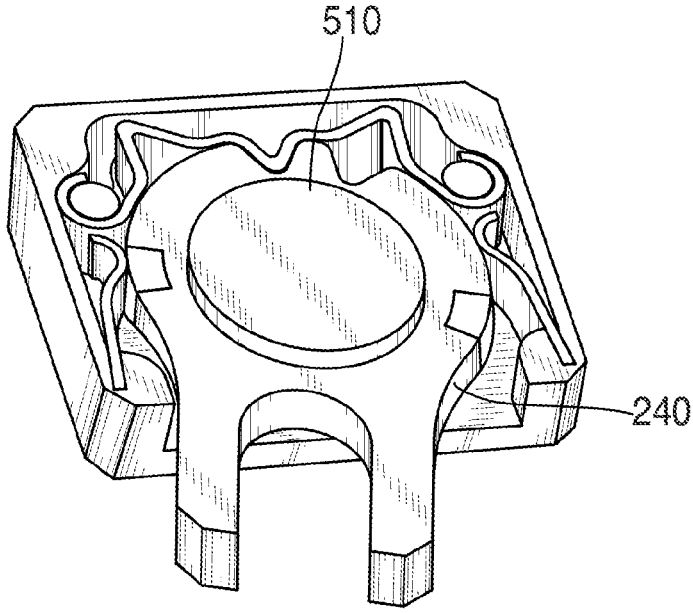
FIG. 6 is an illustrated perspective view of a switch housing and engagement member in accordance with some embodiments of the invention.

Referring now to FIG. 5, an illustrative top view of box housing 230 and engagement member 240 is shown. In addition, FIG. 6 shows an illustrative perspective view of housing 230 and engagement member 240. In the embodiment shown, housing 230 is a four-sided structure with an open face though which a portion of engagement member 240 extends therethrough. That is housing 230 may include a base layer, from which walls 501, 502, and 503 extend, and from which post 232 extends. In this embodiment, there is no cover member that covers any portion of engagement member 240, spring 236, or post 232. A contact spring arm 234 may be coupled to the inside surface of the wall 501 and another contact spring arm 234 may be coupled to the inside surface of wall 503. Radial spring 236 is mounted to housing 230 such that it extends along wall 502.

Housing 230 can be constructed from any suitable material such as plastic, metal, or a combination thereof. For example, the structure of housing 230 can be an injected molded part, and contact spring arms 234 and radial spring 236 can be constructed from metal. In addition, spring arms 234 and radial spring 236 are incorporated into the molded part. Post 232 may be constructed to have tight tolerances so that there is virtually no slop in the coupling with engagement member 240. Engagement member 240 may be secured to post 232 with retaining structure 510 (shown in FIG. 6).

Engagement member 240 may be constructed from any suitable material or combination of materials. For example, the general structure of member 240 can be constructed from a plastic and contact pads 244 can be constructed from a metal. Engagement member 240 can be an integrally formed structure having a protrusion portion and a free spinning portion. The protrusion portion extends beyond the periphery of the sides and engages button 214. In one embodiment, the periphery portion can have two arms (as shown) for interfacing with a pin (not shown) that is part of button 214. In another embodiment, the periphery portion can be a single arm having an extension member that interfaces with the button.

The free spinning portion can include a tightly dimensioned through-hole for coupling to post 232, position notches 242, and contact pads 244. Any suitable number of position notches 242 and contact pads 244 may be present on engagement member 240. The location of position notches 242 may depend on the radius of the free spinning portion. Thus, the greater the radius, the greater the spacing between position notches 242. Position notches 242 may be shaped to promote snug lockup for each switch position.

Although FIGS. 5 and 6 disclosed a 4 sided-structure, it is understood that different structures can be used for box housing 230. For example, box housing 230 can be a five sided structure having an open face through which the protrusion portion of engagement member 240 extends. In this example, top and bottom walls each have a through-hole, which co-aligns with the through-hole of engagement member 240. A post is press fit through the through-holes to secure engagement member within the housing.

Radial spring 236 and its interaction with engagement member 240, and in particular to position notches 242, is discussed. As discussed above, when button 214 is switched from one position to another, this movement is translated to engagement member 240, which results in member 240 rotating from one position to another position. When member 240 rotates from one position to another, radial spring 502 engages one of position notches 242.

Radial spring 236 can be constructed to have a pre-load force for engaging position notches 242 in a manner that is strong enough to eliminate any slop in the movement of engagement member 240 from one position to another. As used herein, "slop" in engagement member movement can be characterized as the wiggling of the engagement member that is created when a small amount of force is applied to the engagement member, where the applied force is insufficient to cause the engagement member to move to a different position switch 242. An advantage of using radial spring 236 in box housing 230 according to this invention is that additional design flexibility is provided as compared to springs used in conventional linear switches.

Figure 7A:
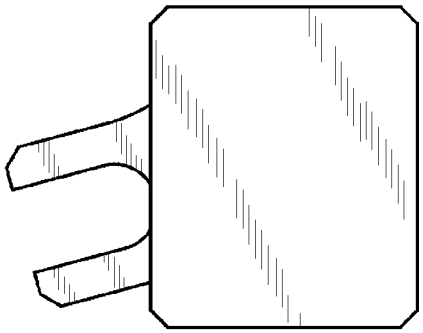
FIGS. 7A-7E show additional views of the switch assembly of FIGS. 5 and 6 in accordance with some embodiments of the invention.
Figure 7B:
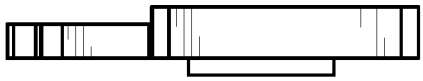
Figure 7C:
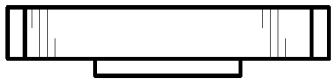
Figure 7D:
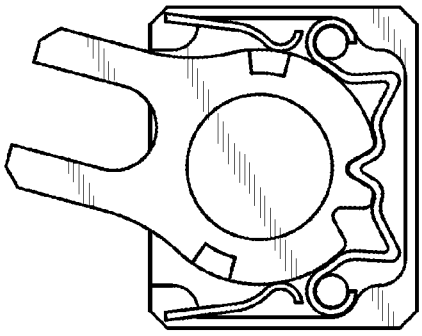
Figure 7E:
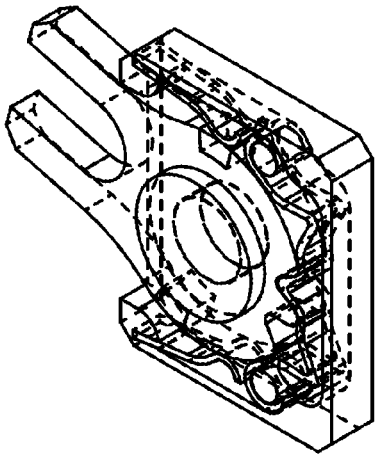

FIGS. 7A-7F shows additional views of a switch assembly of FIGS. 5 and 6 according to an embodiment of the invention. In particular, FIG. 7A shows a top view, FIGS. 7B and 7C show side views, FIG. 7D shows a bottom view, and FIG. 7E shows a perspective view.

It is be understood that various directional and orientational terms such as "up" and "down," "front" and "back," "left" and "right," "top" and "bottom," "above" and "under," and the like are used herein only for convenience, and that no fixed or absolute directional or orientational limitations are intended by the use of these words. For example, the devices of the invention can have any desired orientation. If reoriented, different directional or orientational terms may need to be used in their description, but that will not alter their fundamental nature as within the scope and spirit of the invention. Moreover, it is also to be understood that various types of devices, other than electronic devices, may be provided with one or more switch assemblies of the invention. For example, any mechanical device, such as a board game, may be provided with switch assemblies of the invention.

Those skilled in the art will appreciate that the invention can be practiced by other than the described embodiments, which are presented for purposes of illustration rather than of limitation.

What is claimed is:

1. A cam switch assembly, comprising:

a switch housing comprising a radial spring, a post, and at least two contact spring arms; and an engagement member mounted to and operable to rotate about the post to one of at least two positions, the engagement member comprising:

at least two contact pads;

at least two position notches; and a protrusion portion configured to engage with a linearly slidable button and operably connected to the at least two position notches;

wherein:

the radial spring engages a one of the at least two position notches corresponding to the position of the engagement member, and wherein one of the contact pads engages a corresponding one of the spring members for that position.

2. The switch assembly of claim 1, further comprising a retaining member mounted to the post for securing the engagement member within the switch housing.

3. The switch assembly of claim 1, wherein the radial spring has a spring constant sufficient to ensure wiggle-free lockup between the radial spring and any of the position notches.

4. The switch assembly of claim 1, wherein the engagement member comprises:

a post engagement portion that includes the contact switches and the position notches; and an extension portion that extends from away from the post engagement portion.

5. The switch assembly of claim 4, wherein the extension portion comprises two arms.

6. The switch assembly of claim 1, wherein the switch housing comprises a three-walled structure having an open face through which a portion of the engagement member extends therethrough, the three-walled structure including a first wall, a second wall, and a third wall, wherein the first and third walls flank the open face and the second wall is opposite of the open face.

7. The switch assembly of claim 6, wherein a first spring arm extends from the first wall and a second spring arm extends from the third wall.

8. The switch assembly of claim 6, wherein the radial spring is mounted such that it spans along the second wall.

9. A cam switch assembly, comprising:

a button operative to move to one of at least two positions along a linear track axis;

a switch housing comprising a radial spring, a post, and at least two contact spring arms; and an engagement member coupled to the button and to the switch housing, the engagement member comprising least two contact pads and at least two position notches, and is operative to rotate about a center axis of the post in response to movement of the button to one of the positions, wherein the radial spring engages the position notch corresponding to the position of the button, and wherein one of the contact pads engages a corresponding one of the contact spring arms for that button position.

10. The switch assembly of claim 9, wherein the button comprises a round protruding member, and the engagement member comprises two arm members that engage the round protruding member.

11. The switch assembly of claim 9, wherein the engagement member comprises:

a protruding arm; and a free spinning member coupled to and extending from the protruding arm and which engages the button.

12. The switch assembly of claim 9, wherein the radial spring comprises a spring constant that prevents the engagement member from exhibiting any slop.

13. The switch assembly of claim 9, wherein the radial spring prevents the engagement member from moving unless at least a minimum quantity of force is applied.

14. The switch assembly of claim 9, wherein the post is an integrally formed part of the switch housing.

15. The switch assembly of claim 9, wherein the engagement member comprises a through-hole that is dimensioned to encompass the post.

16. The switch assembly of claim 15, wherein the post is an independent component that is pressfit through the through-hole.

17. An electronic device, comprising:

a housing having a sidewall, which has an exposed periphery and a sidewall plane; and a cam switch assembly mounted within the housing adjacent to the side wall, the switch assembly comprising:

a button having a first portion that extends beyond the exposed periphery and a second portion that extends into the housing;

a switch housing comprising a radial spring, a post, and at least two contact spring arms; and an engagement member coupled to the button and to the post, the engagement member comprising least two contact pads and at least two position notches, wherein the radial spring engages the position notch corresponding to the position of the button, and the engagement member is operative to rotate about a center axis of the post and in a plane co-planer to the sidewall plane in response to linear movement of the button.

18. The device of claim 17, wherein the radial spring engages the position notch corresponding to the position of the button, and wherein one of the contact pads engages a corresponding one of the contact spring arms for that button position.

19. The device of claim 17, wherein the switch housing is a five-sided enclosure with an open face.

20. The device of claim 17, wherein the switch housing is a four-sided enclosure with an open face.

* * * * *